United States Patent [19]

Tran et al.

[11] Patent Number: 4,733,131

[45] Date of Patent: Mar. 22, 1988

[54] MULTIPLE-BEAM KLYSTRON

[75] Inventors: Duc T. Tran, Bures sur Yvette; Georges Faillon, Meudon, both of France

[73] Assignee: Thomson-CSF, Paris, France

[21] Appl. No.: 54,498

[22] Filed: May 27, 1987

[30] Foreign Application Priority Data

May 30, 1986 [FR] France ..... 86 07825

[51] Int. Cl.[4] ..... H01J 25/02

[52] U.S. Cl. ..... 315/5.14; 315/4.0; 315/5.0

[58] Field of Search ..... 315/5.14, 4.0, 5.0

[56] References Cited

U.S. PATENT DOCUMENTS 2,305,884 12/1942 Litton ..... 315/5.35

2,500,944 3/1950 Hansen ..... 315/6.0

3,278,793 10/1966 Dehn ..... 315/5.14

FOREIGN PATENT DOCUMENTS 0121294 10/1984 European Pat. Off. .

*Primary Examiner*—Harold Dixon

*Attorney, Agent, or Firm*—Oblon, Fisher, Spivak, McClelland & Maier

[57] ABSTRACT

The dimensions of the resonant cavities of the multiple-beam klystron are determined in such a way as to enable functioning in the $TM_{0n}$ mode (n=a whole number greater than 1) and drift tubes relative to the beams go through the klystron cavities at places where the electrical field, in the cavities, is at its maximum value. This embodiment results in high-powered klystrons capable at working at high frequencies.

2 Claims, 6 Drawing Figures

FIG_3
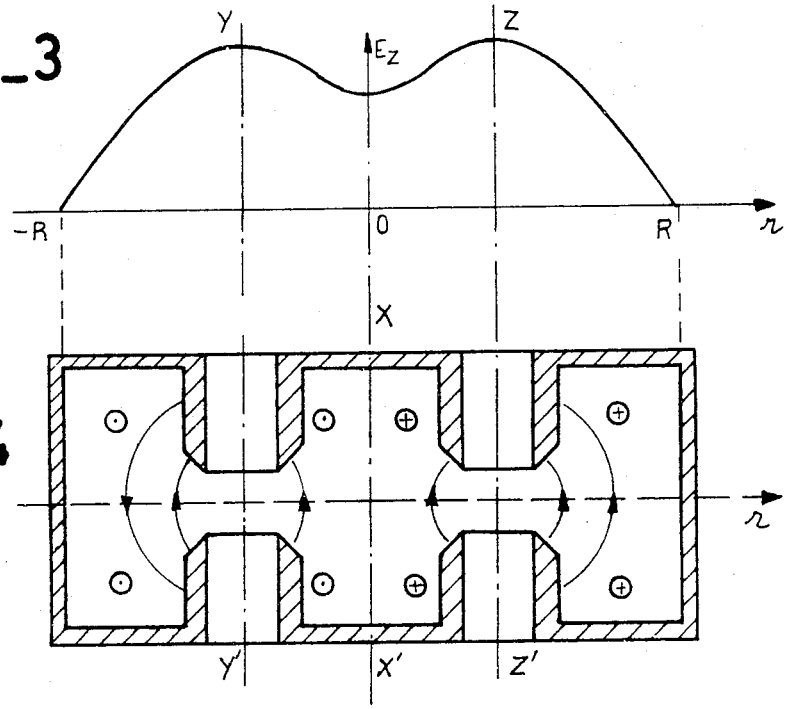
FIG_4
FIG_5
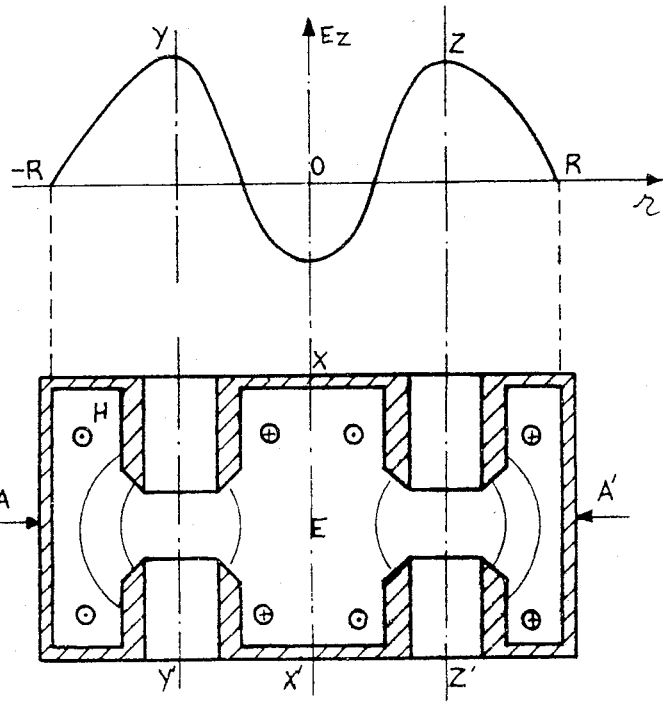
FIG_6

MULTIPLE-BEAM KLYSTRON

BACKGROUND OF THE INVENTION

The present invention pertains to multiple-beam klystrons.

Multiple-beam klystrons are well-known in the prior art. The principle and structure of these klystrons will be recalled in the description of FIGS. 1 and 2.

A great advantage of these klystrons is that they are especially well suited to high-powered operations.

For it can be shown, that for one and the same high-frequency power, the acceleration voltage applied between the anode and a cathode of the klystron is far weaker in a multiple-beam klystron than in a single-beam klystron. Now, regardless of the type of klystron, the need to modulate the speed of the electron beam imposes one and the same upper limit on this acceleration voltage, beyond which the beam can no longer be modulated. Consequently, with a multiple-beam klystron, it is possible to obtain far greater high-frequency power than with a single-beam klystron.

The problem that arises is that it is not possible, with multiple-beam klystrons of the prior art, to obtain high power values at high frequencies.

For, at high frequencies, the dimensions of klystrons become very small. Limits are then imposed by the dimensions of the drift tubes of the cavities, the holes of which must be big enough to allow an electron beam to pass through, and the density of this electron beam should not reach a prohibitive level, all the more so as high power values are sought to be obtained.

In practice, problems arise when it is sought to produce power values of several tens of megawatts at frequencies of several thousands of megahertz.

SUMMARY OF THE INVENTION

The present invention can be used to make very high-powered and ultra high-frequency multiple-beam klystrons.

According to the present invention, there is provided a multiple-beam klystron comprising several resonant cavities, with drift tubes in which the dimensions of the cavities are set in such a way that the klystron workd optimally in the mode $TM_{0n}$ (N being a whole number greater than 1), a klystron in which the drift tubes cross the cavities, passing through a region where, even in the absence of these tubes, the electrical field would have an absolute maximum limit.

BRIEF DESCRIPTION OF THE DRAWINGS

Other objects, characteristics and results of the invention will emerge from the following description, given as a non-exhaustive example and illustrated by the appended figures, of which:

FIGS. 3 and 5 depict the variation of the longitudinal electrical field in a cavity, in the case of a klystron working in the $TM_{01}$ and in the $TM_{02}$ modes respectively;

FIGS. 4 and 6 show a cross-section view of a cavity of a multiple-beam klystron depicting the distribution of the electrical and magnetic fields for a klystron working in the $TM_{01}$ mode and the $TM_{02}$ *mode respectively.*

In the various figures, the same references relate to the same elements but for reasons of clarity, the proportions of the various elements are not the same.

MORE DETAILED DESCRIPTION

Multiple-beam klystrons are improved klystrons in which the goal is to achieve compactness and high efficiency while, at the same time, using only a low accelerating voltage.

It is known that, with the conventional design of klystrons, these three requirements contradict one another. For high efficiency can be obtained only with a beam that has low perveance, namely one with a high voltage. Now, the length of the klystrons increases with the square root of the high voltage.

To get round this difficulty, this beam can be divided into several elementary beams.

The principle can be explained as follows: take a beam divided into N elementary beams, of a current I, accelerated to a voltage V, and let p be the perveance and n the conversion yield between the supplied power VI and the high-frequency power P. The following relations are verified:

$I = pV^{3/2}$.

$P = npV^{5/2}$

If N of these elementary beams are accelerated in parallel, by the same voltage V, the total high-frequency power $P_{TOT}$=:

$$P_{TOT} = N.np.V^{5/2}$$

We therefore get:

$$V = \frac{P_{TOT}^{2/5}}{N.n.P.}$$

For one and the same high-frequency power, the acceleration voltage applied between the anode and the cathode is thus divided by a factor of $N^{2/5}$.

For N=6, the acceleration voltage is divided by $6^{2/5}$, i.e. substantially by a factor of 2.

Figure 1:
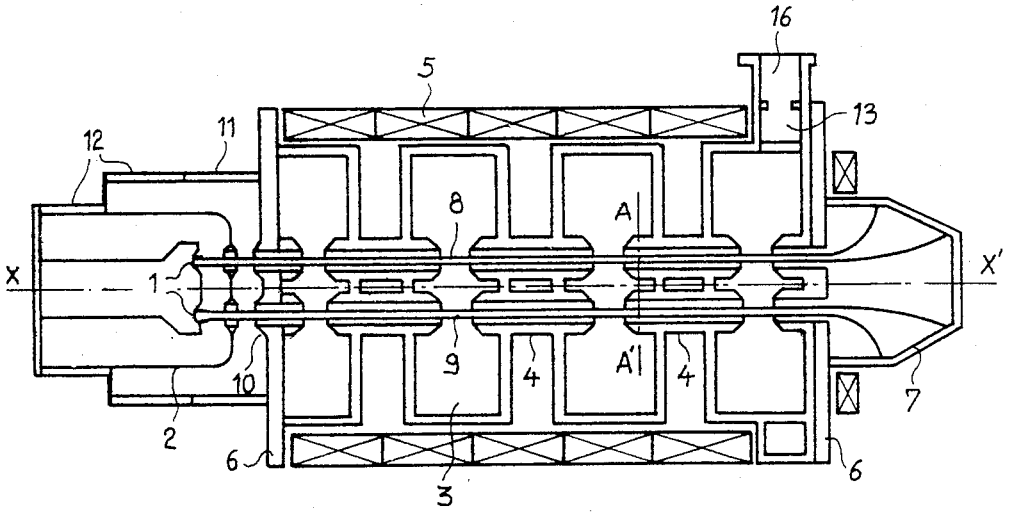
FIG. 1 is a longitudinal cross-section view of a mode of embodiment of a multiple-beam klystron.

FIG. 1 schematically shows a longitudinal cross-section view of one embodiment of a multiple-beam klystron.

This tube comprises an electron gun with cathodes bearing the reference 1 and an anode bearing the reference 2. This anode is drilled with holes set so that they face the cathodes.

This klystron has four resonant cavities 3 which are used to modulate the speed of the beams. Sliding tubes 4 connect the cavities to one another and provide imperviousness.

The resonant cavities 3 are of the re-entrant type. They interact with the excited electromagnetic field in these cavities, through an external source, not shown in the case of the first cavity which is the closest to the electron gun, or through these beams themselves in the following cavities.

The beams are focused by a set of coils 5 arranged around cavities 3. It can be seen in FIG. 1 that, on either side of the set of coils 5, there are two shielding plates 6, made of a magnetic material, for example, soft iron. These plates are drilled with holes of a diameter which is very close to that of the beams so that the beams from the electron guns can pass through into the cavities and then from the cavities towards the collector 7. FIG. 1 depicts two electron beams 8 and 9.

These plates 6 are equipotential surfaces from a magnetic point of view, and they contribute towards creating a magnetic field which is as constant as possible along the tube.

The shielding plate 6, located on the guns side, prevents the leakage field of the coils from reaching the cathodes.

For this, the holes in this shielding plate 6 comprise a swelling 10 pointed towards the cathodes. Moreover, a cylinder 11 made of a magnetic material is attached to this shielding plate 6. This cylinder 11 is connected to other parts 12, which are made of ceramic for purposes of insulation. Finally, an anode 2 made of magnetic material can be used to improve the shielding of the cathodes.

Figure 2:
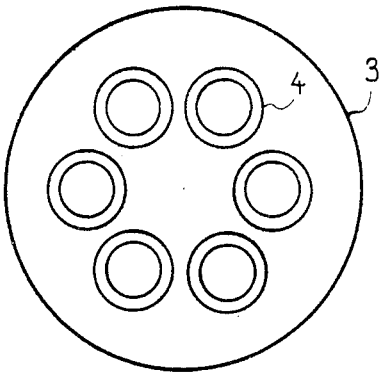
FIG. 2 is a cross-section view along the direction AA' indicated in the FIG. 1.

FIG. 2 is a section view along the direction AA' shown in FIG. 1. It can be seen, in this section, that the klystron of FIG. 1 has six drift tubes 4, hence, six electron beams. The ends of a cavity 3 have been shown, but the focusing device has not been shown.

The drift tubes are arranged in a circle centered on the longitudinal axis XX' of the tube. The angular difference between the tubes is constant. Thus, there is an identical configuration of the electrical field, in each cavity, among the parts of the drift tubes that face one another.

Multiple-beam klystrons of the prior art always work in the $TM_{01}$ mode, i.e. at the lowest frequency.

It is customary, with ultra-high frequency tubes, to work in the fundamental mode.

FIG. 3 shows the variation in the longitudinal electric field $E_z$, after insertion of the drift tubes, in a cavity when the displacement occurs along an axis r, which divides the cavity at its middle and is perpendicular to the longitudinal axis XX' of the klystron, as depicted in FIG. 1.

This field has two maximum values located in the space of interaction lying between the drift tubes as can be seen by looking at FIG. 4 which schematically depicts, in correspondence with FIG. 3, the distribution of the magnetic and electric fields in a cavity seen in a cross-section. Before the insertion of the drift tubes, the field $E_z$ has a single maximum value which is located on the axis XX', and the drift tubes are placed as close as possible to this maximum to avoid disturbing the field $E_z$. However, they disturb the field because, owing to their number and sizes, they cannot be placed along XX'.

The multiple-beam klystrons of the invention work in the $TM_{02}$ mode.

The dimensions of the klystron unit, and the cavities in particular, are set so that the klystron works optimally in the $TM_{02}$ mode.

Changing the sizes of the cavities necessarily entails changes in the other parts of the klystron, such as, for example, the cathodes or the focusing device.

Thus, for equal dimensions and hence, for a given maximum power, the cavities resonate at a frequency which is at least two times higher than for operation in the $TM_{01}$ mode.

It is also possible, if the same frequency is maintained as for functioning in $TM_{01}$ mode, to increase the dimensions of the cavities in order to obtain greater power.

Functioning in the $TM_{02}$ mode therefore makes it possible to obtain mulitiple-beam klystrons of greater power and higher frequency than would be the case with operation in the $TM_{01}$ mode.

FIGS. 5 and 6, which refer to the case of a multiple-beam klystron working in $TM_{02}$ mode, correspond to FIGS. 3 and 4 which refer to a case of functioning in $TM_{01}$ mode.

FIG. 5 therefore depicts variations of the longitudinal electrical field $E_z$, along the axis r, both before and after the insertion of the drift tubes into the cavity.

FIG. 6 depicts the distribution of electrical and magnetic fields in a cavity seen along a section.

Even before the drift tubes are inserted into the cavity, the longitudinal electrical field $E_z$ has two maximum values along the axis r, i.e. the field is at a maximum in a cylinder-shaped region with an axis XX'; the drift tubes cross the cavity, passing through this region, i.e. passing through the place where the electrical field is as constant as possible.

In the interaction spaces located between the drift tubes, the magnetic field is practically nil, a factor that helps keep the electron beam paths in the right direction.

For operation in the $TM_{02}$ mode, the axes YY' and ZZ' of the drift tubes are relatively further away from the axis XX' then for operation in the $TM_{01}$ mode. The drift tubes are therefore relatively more spaced out from one another than is the case with operation in the $TM_{02}$ mode. It is therefore possible to increase the diameter of their holes through which an electron beam is propagated, thus enabling a power build-up.

Consequently, with the $TM_{02}$ mode it is easier to set up multiple-beam klystrons than with the $TM_{02}$ mode.

In the case of multiple-beam klystrons, there is no difficulty about choosing operation in the $TM_{02}$ mode as the modulated beams contain no sub-harmonics. Hence, there is no danger of inefficient operation in the $TM_{01}$ mode. Even if there are sub-harmonics, it is easy to prevent them from being equal to the frequency of the $TM_{01}$ mode.

It must be noted that this invention is not limited to th example of a klystron working in the $TM_{02}$ mode, but can be extended to all the $TM_{0n}$ modes where n is a whole number greater than 1; the drift tubes will then be placed in the zone of an absolute maximum value (i.e. the positive or negative maximum value) of the electrical field as is the case in the description pertaining to the mode $TM_{02}$.

What is claimed is:

1. A multiple-beam klystron comprising several resonant cavities, with drift tubes in which the dimensions of the cavities are set in such a way that the klystron works optimally in the mode $TM_{0n}$ (n being a whole number greater than 1), a klystron in which the drift tubes cross the cavities, passing through a region where, even in the absence of these tubes, the electrical field would have an absolute maximum limit.

2. Klystron according to the claim 1 comprising electron guns, a focusing device set around its cavities and a shielding device comprising:

two plates made of magnetic material set on either side of the focusing device and drilled with holes providing for the passage of the beams, one of these two plates being arranged between the guns and the cavities;

a cylinder made of magnetic material clamped to the plate located between the guns and the cavity;

an anode made of magnetic material.

* * * * *